US005152259A

United States Patent [19]

Bell

[11] Patent Number: 5,152,259

[45] Date of Patent: Oct. 6, 1992

[54] CYLINDER HEAD FOR INTERNAL COMBUSTION ENGINE

[76] Inventor: Darrell W. Bell, P.O. Box 283, Kellyville, Okla. 74039

[21] Appl. No.: 755,442

[22] Filed: Sep. 5, 1991

[51] Int. Cl.[5] ..... F01L 7/02

[52] U.S. Cl. ..... 123/190.2; 123/190.1; 123/80 R

[58] Field of Search ..... 123/190 R, 190 A, 80 R, 123/190 B, 190 BB, 190 BD

[56] References Cited

U.S. PATENT DOCUMENTS

| | | | |
|---|---|---|---|
| 1,702,816 | 2/1929 | Danford | 123/190 A |
| 3,060,915 | 10/1962 | Cole | 123/190 BB |
| 3,993,036 | 11/1976 | Tischler | 123/190 A |
| 4,473,041 | 9/1984 | Lyons et al. | 123/190 A |
| 4,541,371 | 9/1985 | Kageyama et al. | 123/190 A |
| 4,739,737 | 4/1988 | Kruger | 123/190 A |
| 4,751,900 | 6/1988 | Ruffolo | 123/190 BD |
| 4,864,980 | 9/1989 | Riese | 123/190 A |
| 4,944,261 | 7/1990 | Coates | 123/190 A |
| 4,949,685 | 8/1990 | Doland et al. | 123/190 A |
| 4,976,227 | 12/1990 | Draper | 123/190 A |
| 5,005,543 | 4/1991 | Triguero | 123/190 BD |

*Primary Examiner*—E. Rollins Cross
*Assistant Examiner*—Erick Solis

[57] ABSTRACT

A cylinder head for attachment to a block assembly of an internal combustion engine as a replacement for a conventional cylinder head and its conventional valves and associated mechanical components. The cylinder head includes at least one longitudinally disposed spool with ports therein. When the spool is rotated the ports are rotated in a timed manner to be in communication with fluid intake openings and exhaust openings to permit the inflow of fuel into a cylinder in the block assembly and the exit therefrom of exhuast gasses. The use of a spool with ports eliminates the need for conventional valves, thereby permitting a lighter and smaller cylinder head assembly, as well as enables an engine to operate more efficiently at higher than conventional RPMs.

7 Claims, 4 Drawing Sheets

22
48
50
44
46
52
46
54
56
58
46
42
52
46
44

40
62
60
5
5
64
70
6
6
66
64
68
36

CYLINDER HEAD FOR INTERNAL COMBUSTION ENGINE

BACKGROUND OF THE INVENTION

1. Field of the Invention

The present invention relates to a cylinder head for use with an internal combustion engine and, more particularly, to such a cylinder head that does not utilize conventional valves and associated mechanical components.

2. Setting of the Invention

The automobile industry is striving to develop engines of reduced size, increased horsepower and reduced emissions. The benefits of these engine developments will be experienced by the customer, as well as other persons by way of less demand for raw materials and a cleaner environment.

In trying to achieve the above mentioned goals engine designers have found that smaller engines will need to operate at higher than normal revolutions-per-minute (RPMs) and more efficiently. Conventional internal combustion engines with their valves, lifters, rocker arms, springs and push rods have a practical operating limit of about 5,000 rpm. Further, conventional internal combustion engines cannot have their size and weight reduced much below current standards because of the size and mechanical requirements to house, cool and operate the valves, lifters, rocker arms, springs, push rods and etc. There is a need for an internal combustion engine that does not have these drawbacks.

Several innovative internal combustion engine designs have been disclosed in the past, yet none, other than the rotary or Wankel engine, have been widely used. One reason that these innovative designs have not been widely used is because the changing over from one standard type of engine to a potentially radical new design meets with industry and customer resistance. This resistance is partly due to a reluctance to write off investments in conventional tooling and to make all other automobile engines obsolete. Therefore, there is a need for internal combustion engine components that provide the goals mentioned above and can be used in place of or retrofitted to a conventional internal combustion engine.

One innovative internal magazine combustion engine design is disclosed in "Truckin" magazine, September, 1991, at page 26. This engine design used a plurality of spheres mounted separately to thin rods in place of the conventional valve train. Cavities in the spheres permit fluid flow from/into the cylinders when the spheres are rotated.

SUMMARY OF THE INVENTION

The present invention has been designed to overcome the foregoing deficiencies and meet the above described needs. Specifically, the present invention is a cylinder head for attachment to a block assembly of an internal combustion engine in place of the conventional cylinder head, or as part of an entirely new internal combustion engine design.

The cylinder head includes, a cylinder head body that attaches to the engine's block assembly, and has at least one fluid intake opening and at least one exhaust fluid opening in communication with a cylinder bore in the block assembly. At least one spool cavity is provided in the cylinder head body with the cavity being in communication with the at least one fluid intake opening and the at least one exhaust fluid opening.

At least one spool is mounted for axial rotation at least partially within the spool cavity, and includes at least one port therein. The at least one port being arranged so that upon axial rotation of the spool fluid is alternately prevented and permitted to pass from the at least one fluid intake opening into the at least one port and into the cylinder bore, and to pass out from the cylinder bore into the at least one port and out into the at least one exhaust fluid opening.

The cylinder head of the present invention can be made of less material, of a smaller size and of reduced weight because the spool takes the place of the conventional valves and associated mechanical components. Further, with the elimination of the valves and the associated mechanical components the engine can be operated at higher than normal RMs to provide a more efficient engine that generates higher horsepower.

DETAILED DESCRIPTION OF THE PREFERRED EMBODIMENTS

As described above, the present invention is a cylinder head for attachment to a block assembly of an internal combustion engine. As is well known to those skilled in the art, a block assembly of an internal combustion engine contains at least one cylinder bore within which a piston reciprocates and thereby rotates a journalled crankshaft. The crankshaft can be connected directly or through a transmission to various tools or the wheels of a vehicle. Further, on vehicles various devices, such as pumps, an alternator and a distributor, are driven by the rotation of the crankshaft. In conventional internal combustion engines the fuel is introduced into the cylinders by way of flat faced valves with elongated stems which alternately open and seal various ports within the cylinder head. Additional valves are used to seal and open ports to permit exhaust fluids to exit the cylinders. Both of these valves are operated by the rotation of a camshaft that has lobes and/or other devices that push down on the valves to open them. Springs disposed around the upper portion of the valve stems will return the valves to a normally closed position. As described earlier, at higher RPMs, such as above about 5,000 RPM, the operation of the valves and associated mechanical components reach their operational limits. It is the purpose of the present invention to eliminate these devices to provide the benefits of a more efficient and higher RPM engines, as detailed above.

The present invention is a cylinder head for use with an internal combustion engine that does not use conventional valves but uses at least one ported spool that axially rotates within a cavity in the cylinder head. Seals around the spool and in the cylinder head provide the necessary compression containment so that the internal combustion process can be carried out in the engine in a conventional manner.

Figure 1:
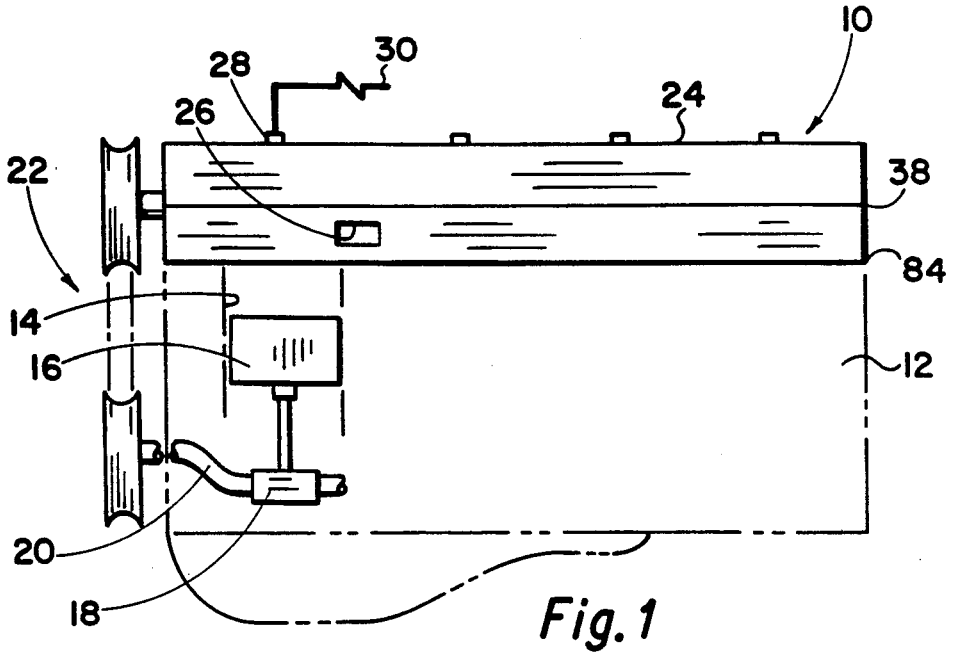
FIG. 1 is a side elevation view of a cylinder head assembly of one preferred embodiment of the present invention mounted to a block assembly of a conventional internal combustion engine, shown in dotted lines.

As shown in FIG. 1, an internal combustion engine 10 includes a block assembly 12 within which is at least one cylinder bore 14 and a reciprocating piston 16 disposed therein. A lower end of the piston 16 is connected by pin and rod bearings 18 to a longitudinally mounted crankshaft 20. A timing gear and belt/chain assembly 22 is connected on the exterior of the block assembly 12, and is used to operate a conventional valve assembly, which the present invention replaces, as described above. A cylinder head 24, in accordance with one preferred embodiment of the present invention, is mounted to the upper portion of the block assembly 12 in any operative manner, such as by the use of bolts or screws, together with a sealing gasket (not shown), as are all well known to those skilled in the art.

The cylinder head 24 of the present invention is intended to replace an existing conventional cylinder head or it can be an integral part of an engine design. The cylinder head 24 can be used with a gasoline, diesel natural gas or other fueled engine. Further, the cylinder head 24 can be used on a single cylinder engine or on an engine with a plurality of cylinders arranged in-line, radially, horizontally, opposed or in a V-pattern. Also, the cylinder head 24 can be used on some dual stroke and most four stroke engines. One preferred embodiment that will be described below is that the cylinder head 24 of the present invention is used to replace as a retrofit the cylinder head from a four stroke, in-line four cylinder gasoline engine, such as found in many conventional subcompact or compact automobiles.

As shown in FIG. 1, the cylinder head 24 includes at least one intake opening 26, which is in communication with the cylinder bore 14, as will be described below, and which is connected to an intake manifold (not shown), as is well known to those skilled in the art. The cylinder head 24 includes spark plugs 28 threaded into bores (not shown) that are in communication with the cylinder bores 14. The operation of the spark plugs is controlled by a mechanical, electronic distributor or other current firing device (not shown) that feeds electrical current in a timed sequence to each of the spark plugs 28 through respective wires 30.

Figure 2:
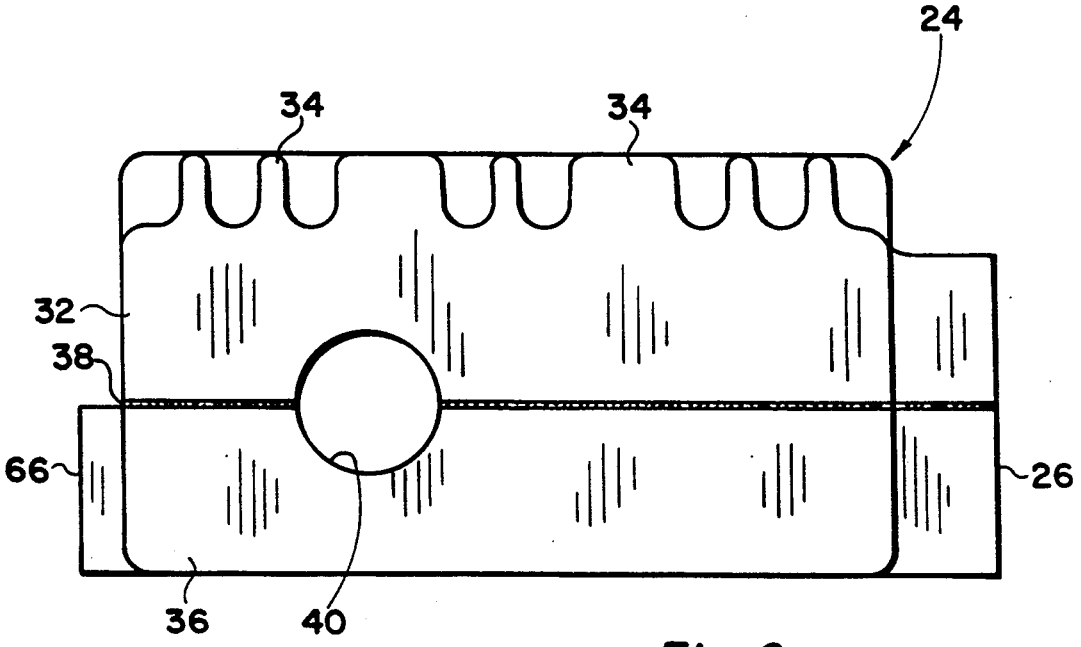
FIG. 2 is a front elevational view of a cylinder head assembly embodying the present invention.

The cylinder head 24 can be formed from a single casting, as are conventional cylinder heads, with the necessary mechanical components mounted to the cylinder head and a cover placed thereover. Preferably, the cylinder head 24 is formed in two sections as shown in FIGS. 1 and 2. An upper section 32, having cooling fins or ribs 34 formed therein or attached thereto, is removably mounted to a lower section 36 by way of bolts (not shown). A sealer or gasket 38 is provided between the two sections to assist in containing any pressurized fluids. On a front face of the cylinder head 24 at least one spool end opening 40 is provided from which a spool (to be described below) extends and interconnects with the timing gear assembly 22.

Figure 3:
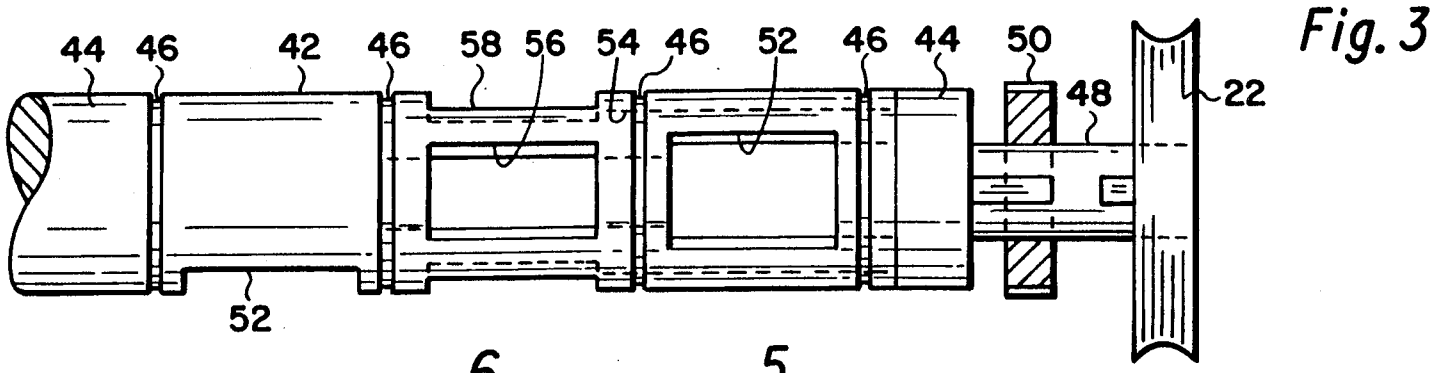
FIG. 3 is a plan view of a spool to be mounted in a cylinder head body of the present invention.

At least one spool, and preferably two spools, is used in the present invention in place of the conventional valves and related mechanical components. FIG. 3 shows a side view of a spool 42 which comprises an elongated cylinder having a series of spaced annular sealed bearings 44 adapted to be mounted within the cylinder head 24, and a series of annular spaced grooves 46 which are used to receive sealing elements, as will be described below. Each spool 42 can be assembled from a series of individual cylindrical or spherical elements, however, it is preferred that each spool 42 be cast, forged or machined as a single unit. While one spool 42 can be used to operate as the intake and exhaust sealing mechanism in place of the intake and exhaust valves, it is preferred that at least two spools 42 be so used with one being for the intake and one for the exhaust. An intake spool 42 is formed from any suitable material, such as steel and preferably stainless steel, while the exhaust spool 42 is formed from a material that can withstand the exhaust fluid temperatures, such as Stellite. The intake and the exhaust spools 42 are essentially identical in configuration except that one or both has an elongated extension 48 that extends out from the front spool end opening 40 in the cylinder head 24. For the purposes of this discussion and the drawings show the exhaust spool 42 having such extension 48 for interconnection with the timing gear assembly 22. Each spool 42 includes a gear or drive mechanism 50 adjacent one end thereof and operatively connected for timed and synchronized rotation of both the intake and the exhaust spools 42 by the rotation of the timing gear assembly 22.

Each spool 42 includes at least one cutout or port that is used to permit fluid flow past the spool 42 and into or out from the cylinder bore 14. Preferably, a first port 52 is machined into or formed into the spool 42 in any configuration desired, such as a generally rectangular or cylindrical opening. The first port 52 is in communication through a longitudinal and internal channel 54 with a second port 56. The second port 56 can be formed from one or more port openings 58 each equally spaced from the other. For example as shown in FIG. 3, four port openings are radially spaced ninety degrees apart. Each cylinder bore 14 will have at least one first port 52 associated therewith and the fluids will either flow thereinto or thereout via the channels 54 into a second port 56 which services at least two cylinders. The configuration of the second port 56 can be designed so that when the spool 42 is rotated fluids are pumped into or out from the channels 54. For example, the angle of the edges of the second port's openings 58 can be chosen so that upon a clockwise rotation of the spool 42 exhaust fluids exiting the cylinder bore 14 will be drawn out into the first port 52, through the channels 54 and out the second port 56 into the exhaust manifold (not shown). Likewise, the same considerations can be used to pump fuel fluids into the cylinder bore 14 via the intake spool's ports 52 and 56.

Figure 4:
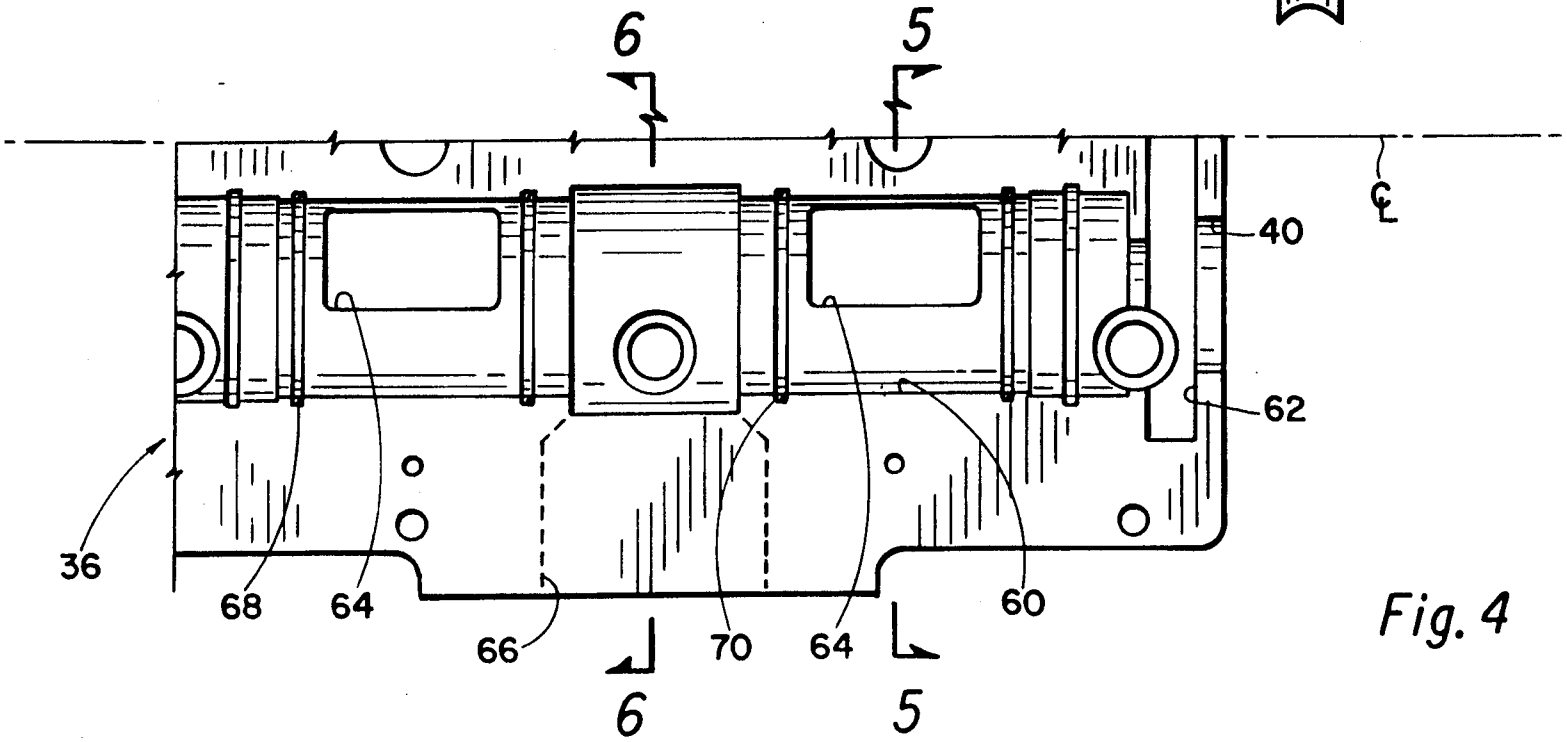
FIG. 4 is a fragmented plan view of one half section of a lower section of a cylinder head body of the present invention.

The spools 42 are mounted for axial rotation by being placed into parallel and longitudinal cavities 60 formed into the upper section 32 and the lower section 36. As shown in FIG. 4, the lower section 36 has a half-cylindrical cavity 60 with a configuration essentially identical to the spool 42 and bearings 44. The upper section 32 has a corresponding half-cylindrical cavity formed in an underside thereof. Further, the upper section 32 and the lower section 36 each include corresponding cavities 62 for receiving thereinto the spool gear assemblies 50, as shown in FIG. 4. The lower section 36 includes at least one cylinder port 64 therethrough per cylinder bore 14 within the cavity 60. As described above, the preferable configuration is to use at least two spools 42 with one being for the intake purpose and the other for the exhaust purposes. FIG. 4 shows such a preferred configuration with the cavity 60 being adapted to receive thereinto the exhaust spool 42, therefore the cylinder port 64 is used as the exit means for exhaust gasses to be removed from cylinder bore 14 and into the first port 52 when the spool 42 is rotated so that the ports 52 and 64 are face-to-face. In FIG. 4 the port 64 is slightly offset from the longitudinal centerline of the cylinder head 14 so that a corresponding intake port (not shown) can be provided in the intake cavity to service the same cylinder bore 14 and provide access of fluid to the at least one fluid intake opening 26. Likewise, either the upper section 32 or the lower section 36 or both will contain at least one exhaust fluid opening 66 in operative communication with an exhaust manifold (not shown).

To provide the necessary sealing action so that the cylinder bore 14 can develop compression when the piston 16 is advanced towards the cylinder head 24, a plurality of graphite, iron, ceramic or elastomeric annular seals 68, the preferred material being the above mentioned graphite capable of withstanding 5,000 degrees Fahrenheit are disposed around the spool 42 at the grooves 46 and are received into cooperative grooves 70 in the upper section 32 and the lower section 36. The type and configuration of such seals 68 can be readily determined by those skilled in the art.

Figure 5:
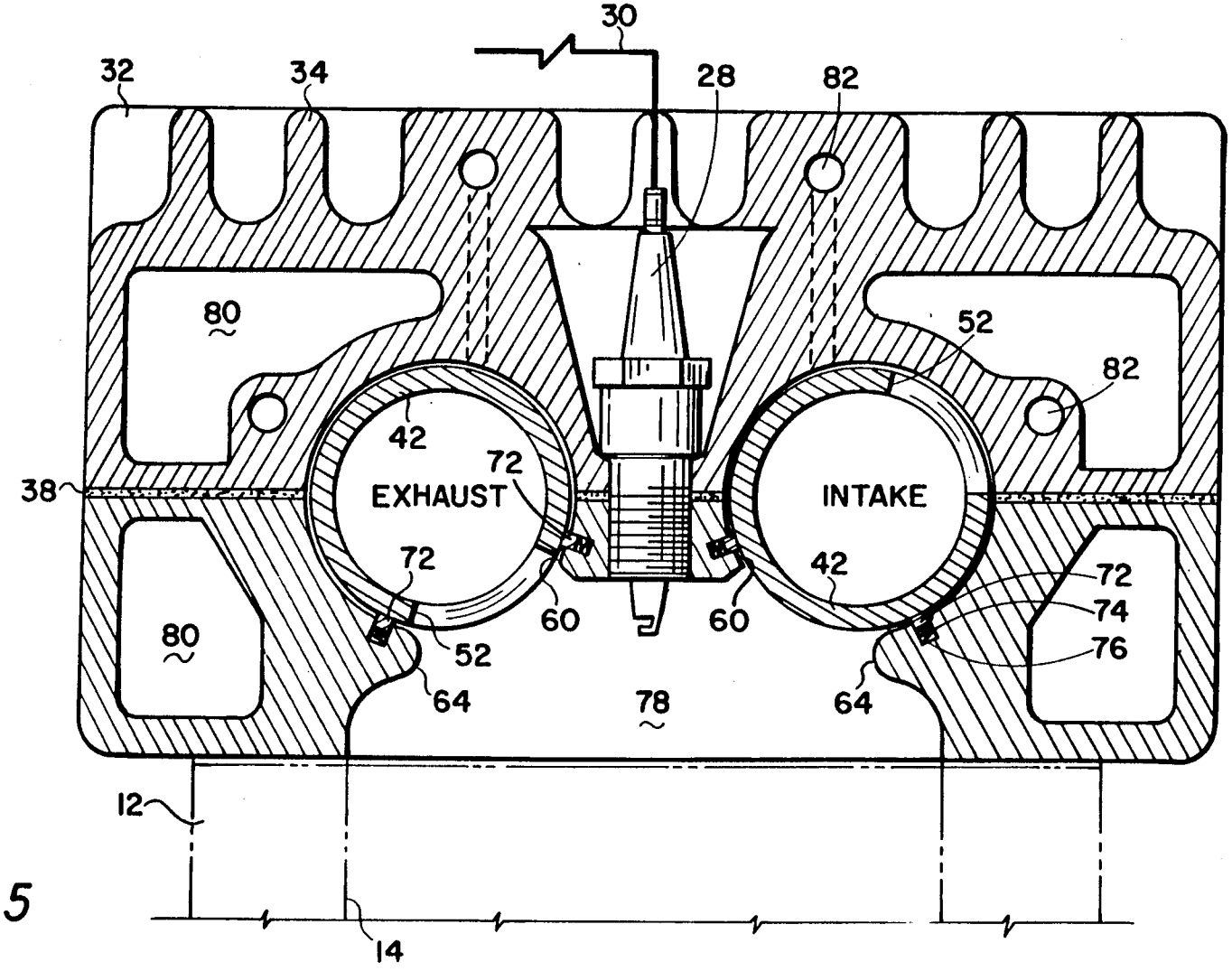
FIG. 5 is a sectional view of a cylinder head assembly of FIG. 4 and taken along Line 5—5 of FIG. 4.

FIG. 5 is a lateral section through the assembled cylinder head 24 along a line passing through a spark plug 28 showing the elevation details of the internal features of the cylinder head 24. Likewise, FIG. 6 is a lateral section through the assembled cylinder head 24 along a line passing through the second port 56.

The necessary sealing action for compression is also provided by a plurality of rectangular graphite seals 72 capable of withstanding 5,000 degrees Fahrenheit set longitudinally in the lower section 36 on either side of the cylinder ports 64. The seals 72 are biased towards the spools 42 under tension by utilizing wave springs 74 or other pressurizing devices set into rectangular recesses 76 in an underside of the lower section 36.

The underside of the lower section 36 includes a generally hemispherical or domed cavity 78 which is coaxially disposed over the cylinder bore 14. As is well known to those skilled in the art, a hemispherical cavity or "hemi-head" provides for a more efficient fuel burning process within the cylinder and thus greater horsepower and fuel efficiency. Further, as is well known to those skilled in the art, the vertical and centered arrangement of each spark plug 28 causes the fuel's flame front to proceed outwardly and downwardly in a symmetrical pattern rather than laterally in most conventional engines, which introduces wasted motion and causes a slight overturning moment to the piston 16 that can add to piston ring and cylinder wear.

Figure 6:
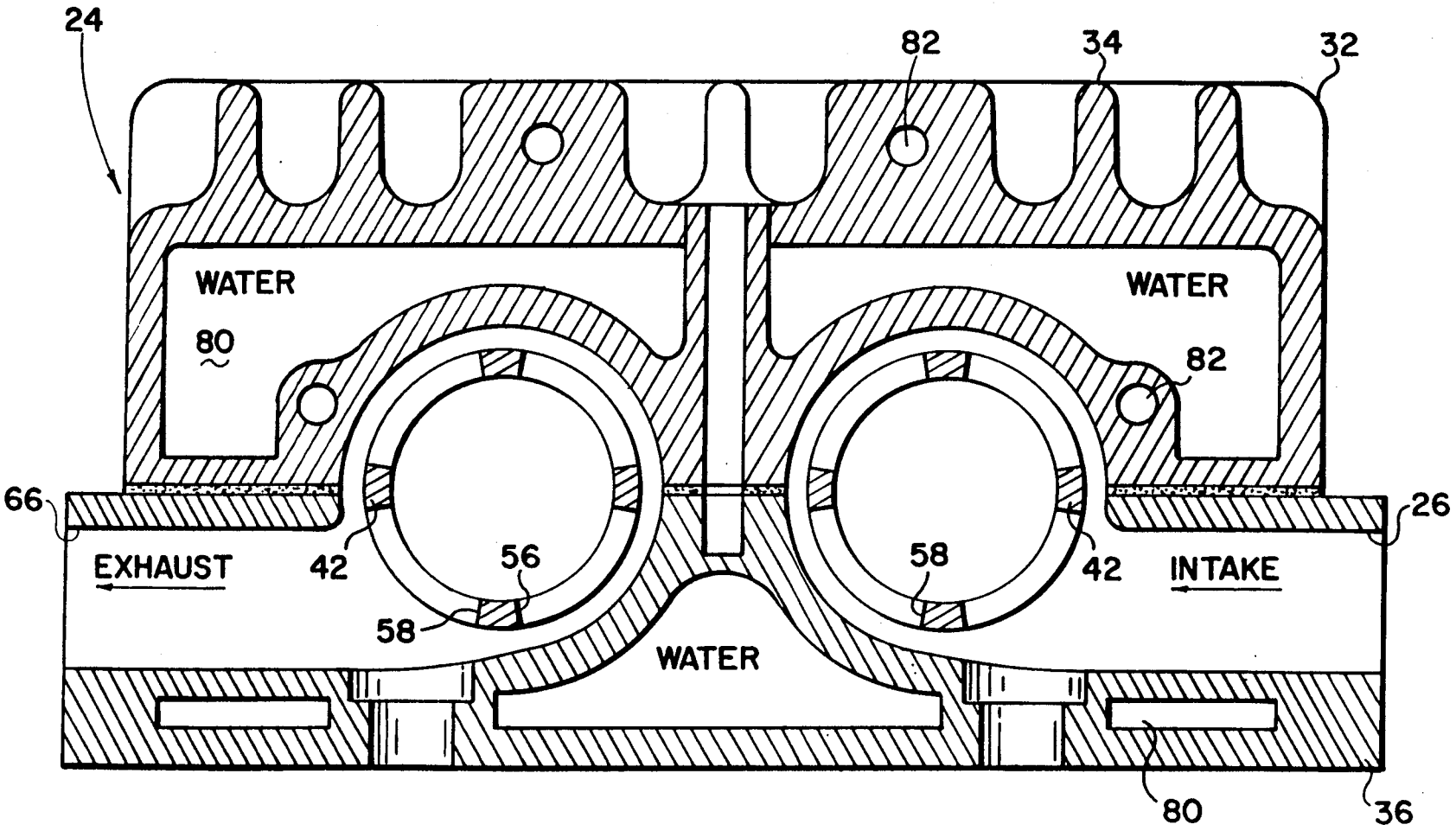
FIG. 6 is a sectional view of a cylinder head assembly of FIG. 4 and taken along Line 6—6 of FIG. 4.

As shown in FIGS. 5 and 6, the upper section 32 and the lower section 36 include internal passageways or channels for coolant liquids 80 and for lubricating fluids 82. Since the cylinder head 24 does not include a plurality of conventional valves and the associated mechanical components, the channels 80 and 82 can be made larger than those in conventional cylinder heads thereby enabling the cylinder head 24 to operate at a cooler than conventional temperature and with more even temperature distribution to reduce warpage and overheating.

The present invention operates in the following manner. A conventional cylinder head is removed from an existing internal combustion engine in the well known manner. A new head gasket 84 is fitted to an upper portion of the block assembly 12, and the assembled cylinder head 24 and/or the lower sub assembly is attached thereto by way of a plurality of bolts or screws (not shown). The upper head and assemblies can then be installed. The timing gear assembly 22 is interconnected to the extension 48 of the exhaust spool 42 by way of a pulley or gear. The "valve timing" of the present invention is very simple as compared to the conventional valve timing. Timing is ensured by rotating the spool gear assembly 50 so that the intake and the exhaust spools have the proper radial relationships, and then rotating the extension 48 until the intake and exhaust ports on the spools are in proper opened/closed relationship to the position of the timing mark on a flywheel or other timing indicator on the crankshaft 20, as are all well known to those skilled in the art.

A conventional intake manifold is mounted across the fluid intake opening 26, a conventional exhaust manifold is mounted across the exhaust fluid opening 66, and sources of electrical current, fuel, coolant fluid and lubricating fluid are operatively connected to the engine, as are well known to those skilled in the art. Once the engine's crankshaft 20 is rotated, such as by a starter, fuel is admitted into the intake fluid opening 26 where it passes in a timed sequence through the port openings 58, through the channels 54 and out from the first ports 52 through the cylinder port 64 and into the cylinder bore 14, as shown in FIG. 5. As the crankshaft 20 is rotated the timing gear assembly 22 and the spool gear assembly 50 rotate the intake and the exhaust spools 42 so that the cylindrical wall of the intake spool 42 is rotated to form a seal across the intake cylinder port 64. The first port 52 of the exhaust spool 42 is rotated but will still form a seal in the same manner against its exhaust cylinder port 64. Electrical current from a mechanical, electronic distributor or other current firing device passes through the wire 30 to cause a spark within the cylinder bore 14 at the spark plug 28.

The electrical spark ignites the fuel mixture creating an explosive force that drives the piston 16 downwardly, which in turn rotates the crankshaft 20 and the spools 42. The piston 16 is mechanically moved upwards by the rotation of the crankshaft 20 to force exhaust fluids out from the cylinder bore 14. The exhaust spool 42 has been rotated so that the exhaust first port 52 is aligned face-to-face with the exhaust cylinder port 64 thereby providing a passageway for the exhaust fluids to exit. This rotation of the exhaust spool 42 ensures that heat from the exhaust fluids will be dissipated across the entire contacting area rather than a single hot spot. The exhaust fluids exit from the first port 52 through the channel 54 and out from the second port 56 and into the exhaust fluid opening 66 and the exhaust manifold. With the continued rotation of the crankshaft 20, the operation of the engine 10 continues as is well known to those skilled in the art.

Wherein the present invention has been described in particular relation to the drawings attached hereto, it should be understood that other and further modifications, apart from those shown or suggested herein, may be made without the scope and spirit of the present invention.

What is claimed is:

1. A cylinder head for attachment to a block assembly having at least one cylinder bore therein, the cylinder head comprising:

a cylinder head body adapted for attachment to the block assembly and having at least one side-entry fluid intake opening in communication with the cylinder bore, and having at least one side-exit exhaust fluid opening in communication with the cylinderbore; the cylinder head body including two parallel spool cavities, an intake spool cavity in communication with the fluid intake opening and an exhaust spool cavity in communication with the exhaust fluid opening;

an intake spool mounted for axial rotation within the intake spool cavity, and including at least one intake port in communication through an internal longitudinal channel with a spaced second intake port having a plurality of openings;

an exhaust spool mounted for axial rotation within the exhaust spool cavity, and including at least one exhaust port in communication through an internal longitudinal channel with a spaced second exhaust port having a plurality of openings;

timing means for rotating the intake spool and the exhaust spool; and the at least one intake port and the at least one exhaust port being spaced and arranged so that upon axial rotation of the intake spool and the exhaust spool, fluid is alternately prevented and permitted to pass from the at least one fluid intake opening, pumped through the second intake port and channel, into the at least one intake port and into the cylinder bore, and to pass from the cylinder bore into the at least one exhaust port, pumped through the channel and second exhaust port, and out from the at least one exhaust fluid opening.

2. A cylinder head of claim 1 wherein the second intake port is in communication with two adjacent cylinder bores through the intake channel and spaced intake ports arranged one above each cylinder bore; and the second exhaust port is in communication with the two adjacent cylinder bores through the exhaust channel and spaced exhaust ports arranged one above each cylinder bore.

3. A cylinder head of claim 1 wherein the cylinder head body includes channels for internal passage of coolant fluid and lubricating fluid.

4. A cylinder head of claim 1 and including at least one spark plug bore per cylinder bore for receiving a spark plug, and the at least one spark plug bore being located on the longitudinal and transverse center line of the cylinder head body.

5. A cylinder head of claim 1 and including means for attachment to the block assembly.

6. A cylinder head of claim 1 wherein the cylinder head body comprises an upper section and a lower section with the spool cavity being formed by indentations in an underside of the upper section and indentations in a topside of the lower section.

7. A cylinder head of claim 1 and including sealing means in the cylinder head body extending into the spool cavities for preventing leakage of fluids into or from areas adjacent the at least one intake port and the at least one exhaust port.

* * * * *